US006686548B2

(12) United States Patent
Chen

(10) Patent No.: US 6,686,548 B2
(45) Date of Patent: Feb. 3, 2004

(54) QUICK SHUT-OFF DEVICE FOR GRINDING TOOL

(76) Inventor: Ruey-Zon Chen, No. 261, Jen Hwa Road, TaLi City, TaiChung, Hsien (TW)

( * ) Notice: Subject to any disclaimer, the term of this patent is extended or adjusted under 35 U.S.C. 154(b) by 18 days.

(21) Appl. No.: 10/147,820

(22) Filed: May 20, 2002

(65) Prior Publication Data

US 2003/0213682 A1 Nov. 20, 2003

(51) Int. Cl.[7] ..... H01H 23/00

(52) U.S. Cl. ..... 200/332.2; 200/293.1; 200/329

(58) Field of Search ..... 200/61.85, 293.1, 200/303, 329, 330, 331, 332.1, 332.2

(56) References Cited

U.S. PATENT DOCUMENTS 4,006,334 A * 2/1977 Robotham et al. ..... 200/43.17
4,380,693 A * 4/1983 Kuhlmann et al. ..... 200/330
4,906,804 A * 3/1990 Theimer ..... 200/52 R
4,973,807 A * 11/1990 Stabler et al. ..... 200/321

* cited by examiner

*Primary Examiner*—Michael Friedhofer
(74) *Attorney, Agent, or Firm*—Rosenberg, Klein & Lee

(57) ABSTRACT

A grinding tool includes a handle with a grinding wheel connected thereto and driven by a driving device. An opening is defined in the handle and a switch device is received in the opening with which a cover is engaged. A recess is defined in an outer periphery of the cover and a hole is defined through the cover. A pushing member is slidably engaged with the recess and a stepped protrusion extending from an underside of a first end of the pushing member is engaged with an inner periphery of the hole. A gap is defined between a second end of the pushing member and a surface defining the recess. An activation member is connected to the sliding member via the hole and has a convex contacting the switch device. A spring is connected between the cover and the activation member. The activation member shuts off the switch device when the sliding member is pulled by the spring by pushing the second end of the pushing member.

4 Claims, 8 Drawing Sheets

QUICK SHUT-OFF DEVICE FOR GRINDING TOOL

FIELD OF THE INVENTION

The present invention relates to a quick shut-off device for a grinding tool and includes a pushing member connected to a spring so that when the user pushes an end of the pushing member, the switch of the grinding tool is then shut off immediately.

BACKGROUND OF THE INVENTION

A conventional portable grinding tool is shown in FIG. 1 and generally includes a handle 70 with a driving device 72 connected to a first end of the handle 70 and a grinding wheel 71 is connected to and driven by the driving device 72. A switch 73 is connected to a second end of the handle 70 so that the driving device 72 is activated or stopped by operating the switch 73. The grinding tool is heavy so that the user usually holds the handle 70 with his/her two hands. In a situation when the grinding wheel 71 is broken by an impact with a hard object, the debris could fly to hit the user at a high speed and the user has to shut off the driving device 72 as soon as possible. However, when the grinding tool is operated in a narrow space, the two hands of the user are not convenient to remove from the handle 70 to operate the switch 73. Therefore, how to shut off the driving device 72 within a short period of time when the emergency situation happens is important.

Referring to FIG. 2 which shows another type of the conventional grinding tool 80 and the switch 81 is connected to a surface of the handle 82 and the switch 81 extends from the surface of the handle 82. The switch 81 is easily to be touched or activated when putting the tool 80 on the ground, or by unintentional access. This will activate the grinding wheel 83 without expectation and could hurt the grinding wheel 83 and/or the people around the grinding tool 80.

The present invention intends to provide a quick shut-off device for the grinding tool that has a pushing member on the handle and can be touched to shut off the electric power to stop the driving device.

SUMMARY OF THE INVENTION

In accordance with one aspect of the present invention, there is provided a grinding tool which comprises a handle having a driving device at a first end of the handle so as to drive a grinding wheel. An opening is defined in the handle and a switch device is received in the opening. A cover is engaged with the opening and has a recess de fined in an outer periphery of the cover. A hole is defined through the cover.

A pushing member is slidably engaged with the recess and a stepped protrusion extends from an underside of a first end of the pushing member so as to be engaged with an inner periphery of the hole. A gap is defined between a second end of the pushing member and a surface defining the recess.

An activation member extends through the hole and is located between the stepped protrusion and the second end of the pushing member. The activation m ember is fixed to the pushing member and has a convex which contacts the switch device.

A spring has a first end connected to the cover and a second end of the spring is connected to the activation member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
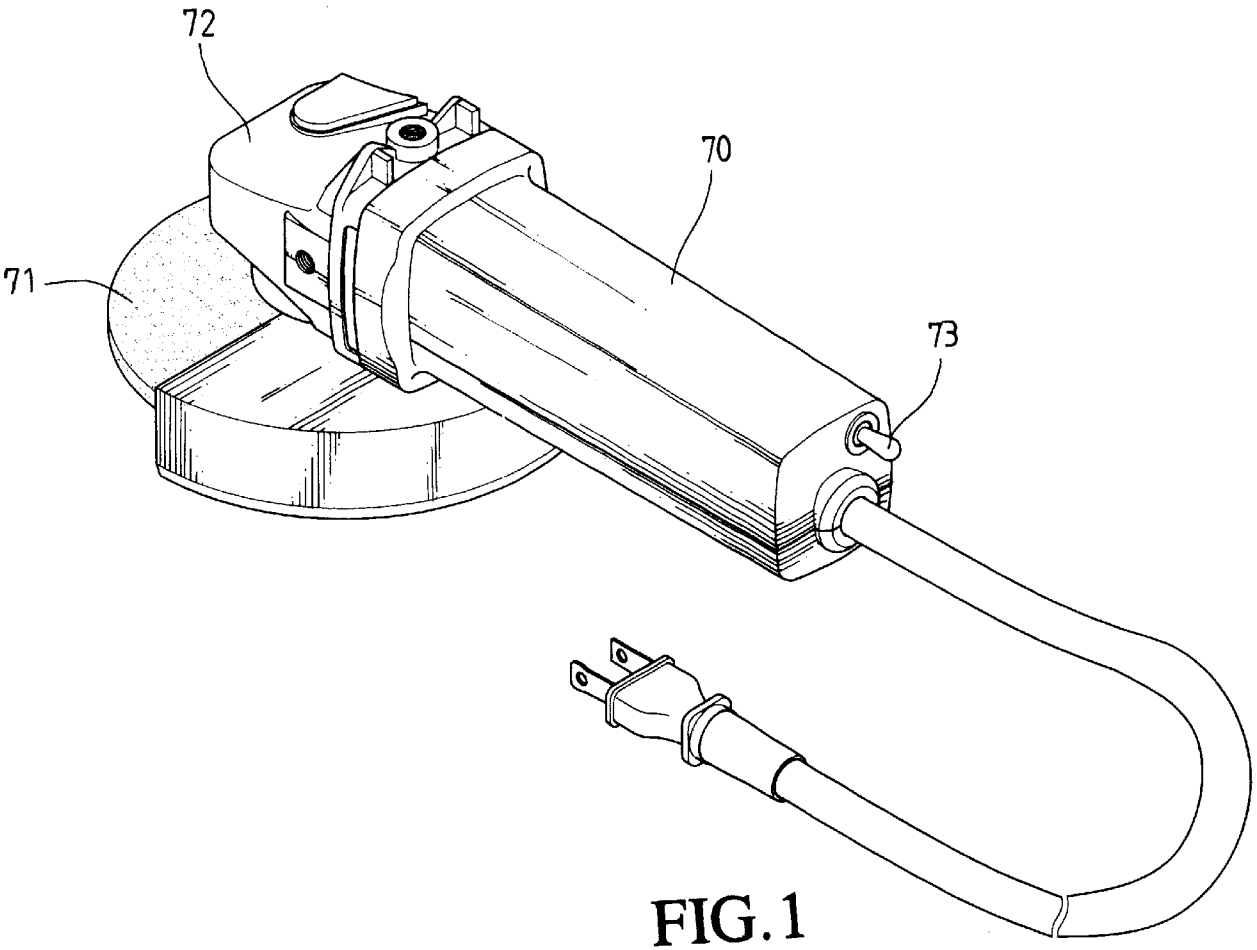
FIG. 1 PRIOR ART
FIG. 1 is a perspective view to show a conventional grinding tool.
Figure 2:
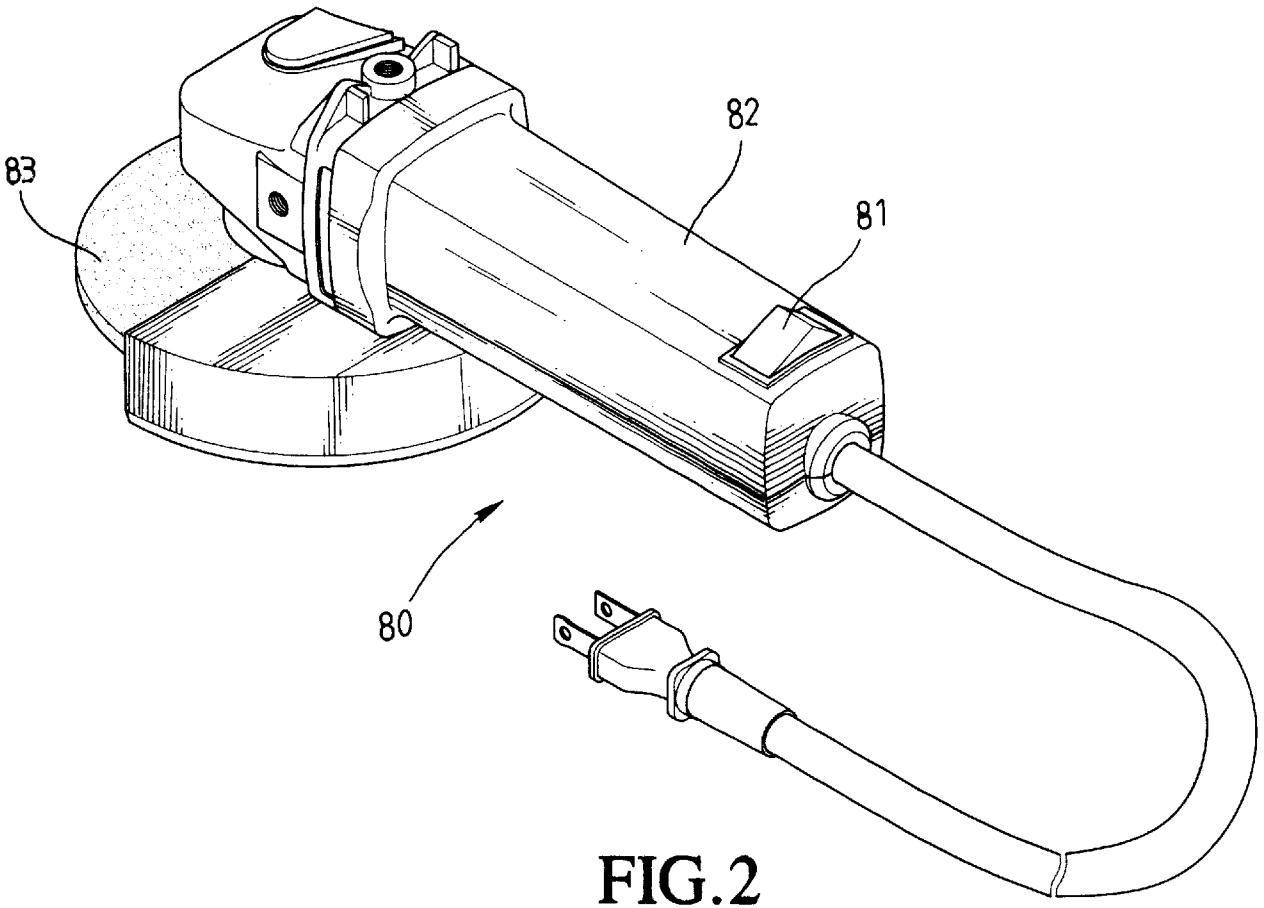
FIG.2 PRIOR ART
FIG. 2 is a perspective view to show another embodiment of the conventional grinding tool.
Figure 3:
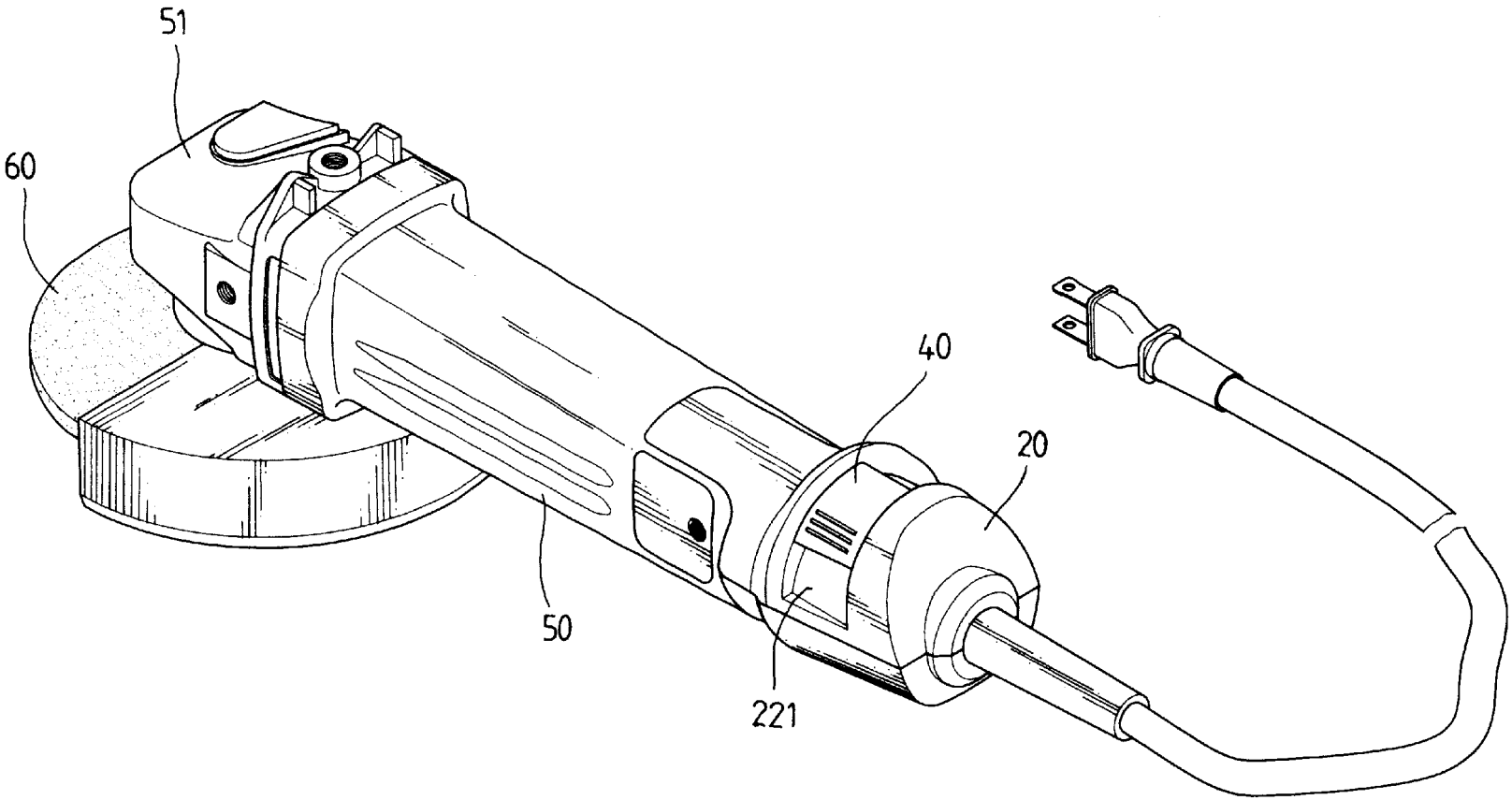
FIG. 3 is a perspective view to show the grinding tool of the present invention.
Figure 4:
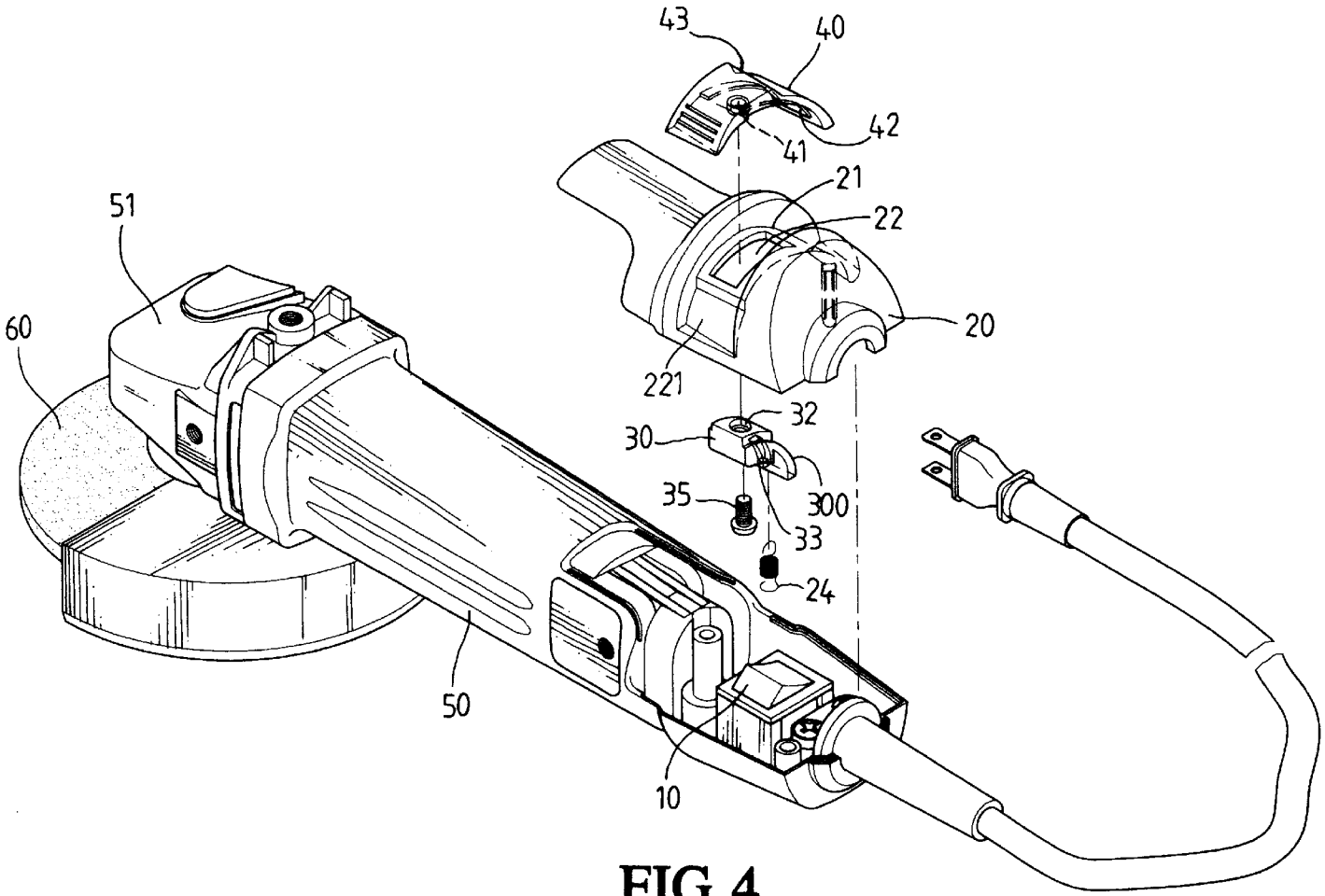
FIG. 4 is an exploded view to show the quick shut-off device of the grinding tool of the present invention.
Figure 5A:
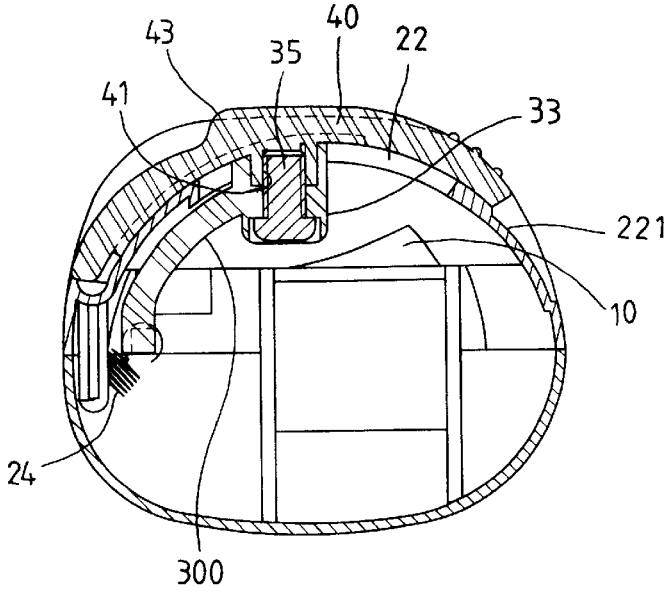
FIGS. 5A, 5B an d 5C show the steps of setting th e pushing member to start the switch device of the grinding tool of the present invention.

Referring to FIGS. 3, 4, and 5A, the grinding tool of the present invention comprises a handle 50 having a driving device 51 connected to a first end of the handle 50 and a grinding wheel 60 is connected to and driven by the driving device 51. An electric cable is connected to a second end of the handle 50. An opening is defined in the handle 50 and a seesaw type switch device 10 is received in the opening. A cover 20 is engaged with the opening and has a recess 21 defined in an outer periphery of the cover 20 and a hole 22 is defined through the cover 20.

A pushing member 40 is slidably engaged with the recess 21 and a stepped protrusion 42 extends from an underside of a first end of the pushing member 40 so as to be engaged with an inner periphery of the hole 22. A gap is defined between a second end of the pushing member 40 and a surface defining the recess 21. A pushing ridge 43 extends from a top surface of the pushing member 40 so that the user may push the pushing member 40 by using a thumb to push the pushing ridge 43.

An activation member 30 extends through the hole 22 of the pushing member 40 and is located between the stepped protrusion 42 and the second end of the pushing member 40. The activation member 30 has a convex 33 which contacts the switch device 10 and a hole 32 is defined through the convex 33 so that a screw 35 extends through the hole 32 and is threadedly engaged with a threaded hole 41 defined in an underside of the pushing member 40.

A spring 24 has a first end connected to the cover 20 and a second end of the spring 24 connected to an extension portion 300 of the activation member 30 as shown in FIG. 5A.

Figure 5B:
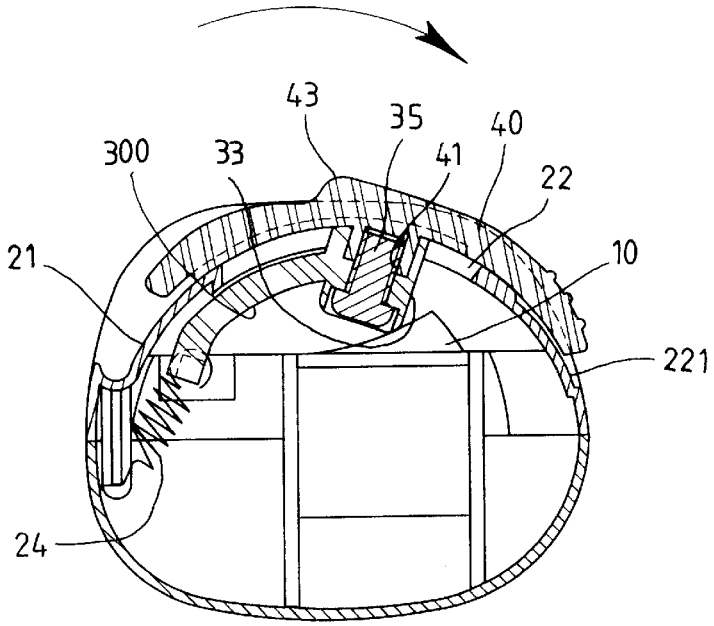
Figure 5C:
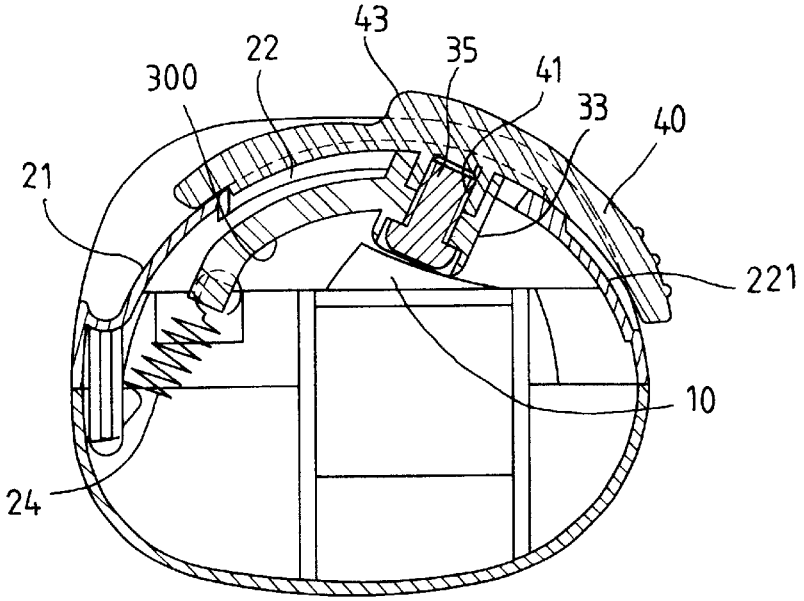
Figure 6:
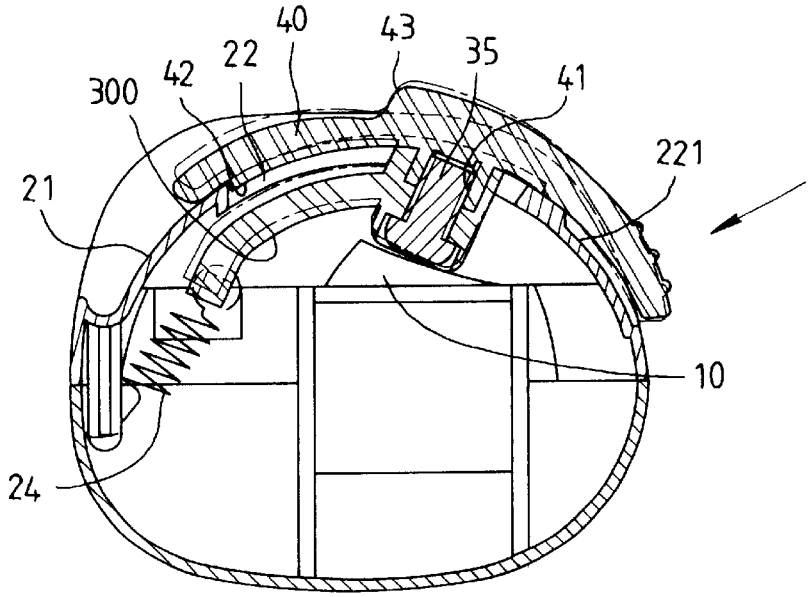
FIG. 6 is a cross sectional view to show, the pushing member is pushed to shut off the switch device.
Figure 7A:
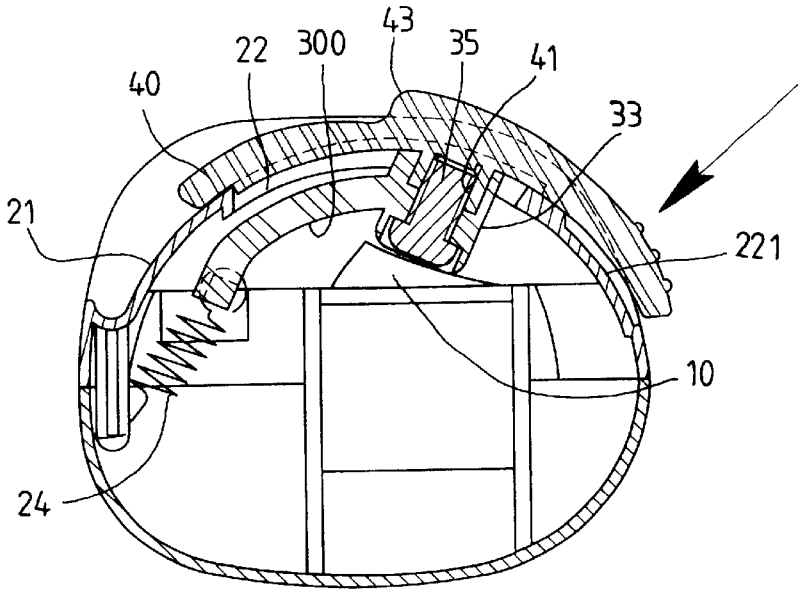
FIGS. 7A, 7B and 7C show the steps of releasing the pushing member to shut off the switch device of the grinding tool of the present invention.
Figure 7B:
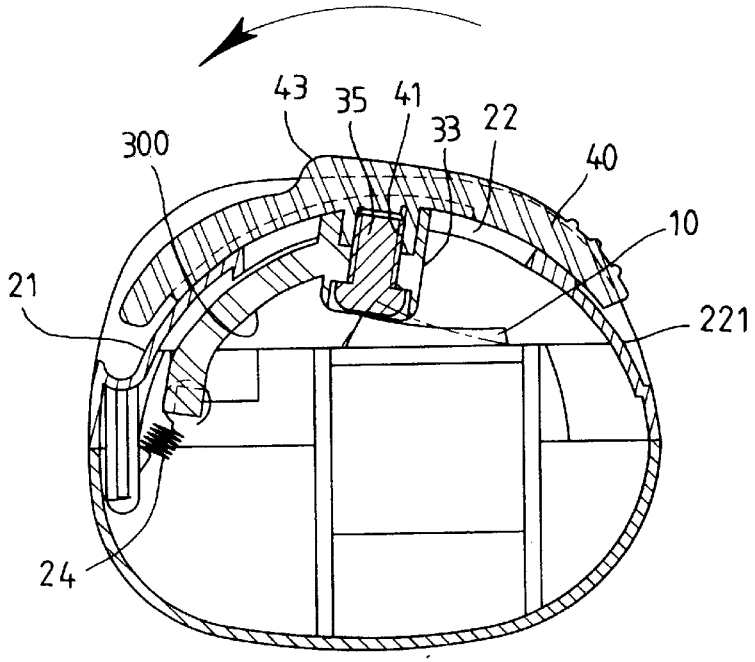
Figure 7C:
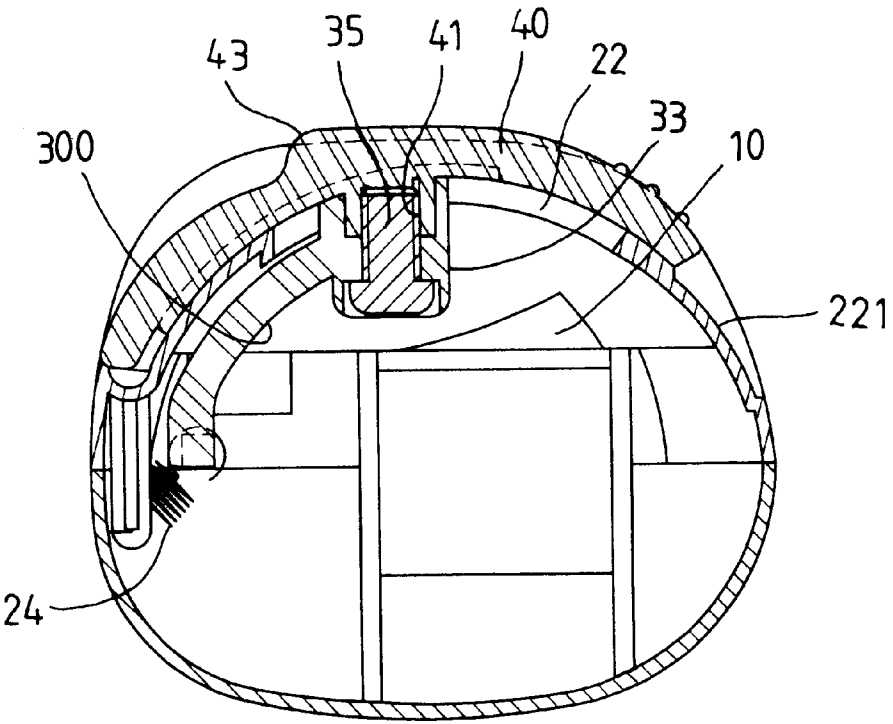

As shown in FIGS. 5B and 5C, the pushing member 40 is pushed to extend the spring 24 by pushing the pushing ridge 43 till the stepped protrusion 42 on the underside of the first end of the pushing member 40 is engaged with the inner periphery of the hole 22. At this position, the seesaw switch device 10 is set at start position and the grinding tool is in operation condition.

Referring to FIGS. 6, 6A, 6B and 6C, when in emergency situation and the grinding tool has to be shut off immediately, the user may push the second end of the pushing member 40 and the first end of the pushing member 40 is then raised to disengage the stepped protrusion 42 from the inner periphery of the hole 22, the pushing member 40 is then pulled by the spring 24 and the convex 33 pushes the switch device 10 to stop position. It is to be noted that the user simply pushes the second end of the pushing member 40, the spring 24 pulls the pushing member 40 and the switch device 10 immediately shut off.

While we have shown and described the embodiment in accordance with the present invention, it should be clear to those skilled in the art that further embodiments may be made without departing from the scope of the present invention.

What is claimed is:

1. A grinding tool comprising:

a handle having a driving device connected to a first end of the handle and a grinding wheel connected to and driven by the driving device, an electric cable connected to a second end of the handle, an opening defined in the handle and a switch device received in the opening;

a cover engaged with the opening and having a recess defined in an outer periphery of the cover, a hole defined through the cover;

a pushing member slidably engaged with the recess and a stepped protrusion extending from an underside of a first end of the pushing member so as to be engaged with an inner periphery of the hole, a gap defined between a second end of the pushing member and a surface defining the recess;

an activation member extending through the hole and located between the stepped protrusion and the second end of the pushing member, the activation member fixed to the pushing member and has a convex which contacts the switch device, and a spring having a first end connected to the cover and a second end of the spring connected to a combination of the activation member and the cover.

2. The grinding tool as claimed in claim 1, wherein the activation member has an extension portion to which the second end of the spring is connected.

3. The grinding tool as claimed in claim 1, wherein the activation member has a hole defined through the convex and a screw extends through the hole and is threadedly engaged with the pushing member.

4. The grinding tool as claimed in claim 1 wherein the sliding member has a pushing ridge extending from a top surface thereof.

* * * * *